US006191056B1

(12) United States Patent
Vogt et al.

(10) Patent No.: US 6,191,056 B1
(45) Date of Patent: Feb. 20, 2001

(54) PRIMER COATING PROVIDING A METALLIZED FABRIC EXHIBITING IMPROVED WASHFASTNESS

(75) Inventors: Kirkland W. Vogt, Simpsonville; Kristen K. Arthur, Spartanburg, both of SC (US)

(73) Assignee: Miliken & Company, Spartanburg, SC (US)

( * ) Notice: Under 35 U.S.C. 154(b), the term of this patent shall be extended for 0 days.

(21) Appl. No.: 09/400,511

(22) Filed: Sep. 20, 1999

(51) Int. Cl.[7] ..... D03D 15/00; B05D 1/36

(52) U.S. Cl. ..... 442/148; 442/152; 442/153; 442/164; 442/228; 427/203; 427/205; 427/214; 427/412; 526/274

(58) Field of Search ..... 442/148, 152, 442/153, 164, 228; 427/203, 205, 214, 412; 526/274

(56) References Cited

U.S. PATENT DOCUMENTS

| | | | |
|---|---|---|---|
| 3,660,138 | 5/1972 | Gorrell | 117/35 V |
| 4,390,588 | 6/1983 | Ebneth et al. | 428/263 |
| 5,271,998 | 12/1993 | Duckett | 428/251 |
| 5,744,405 | 4/1998 | Okumura et al. | 442/71 |

FOREIGN PATENT DOCUMENTS 800093 8/1958 (GB) .

OTHER PUBLICATIONS

Maege, Iris, et al., "Self–assembling adhesion promoters for corrosion resistant metal polymer interfaces," *Progress in Organic Coatings 34* (1998), pp. 1–2 (Elsevier).

*Primary Examiner*—Blaine Copenheaver
*Assistant Examiner*—Arti R. Singh
(74) *Attorney, Agent, or Firm*—Terry T. Moyer; William S. Parks

(57) ABSTRACT

This invention relates to metallized, particularly aluminized, fabrics which are coated with specific polyurethane finishes and primer coatings comprising novel phosphate-containing primers. Such specific polyurethanes are cross-linked when reacted with the primer coatings and applied in latex form. Upon impregnation within metal-coated fabrics, these particular polyurethanes encapsulate the metal particles and provide vastly improved washfastness properties to the fabrics and thus ensure the retention of substantially all the metal coating within and on the target fabric. The phosphate-containing primer provides remarkably improved adhesion between the metal and the polyurethane for excellent durability and washfastness. The primer compositions as well as the methods of producing a metallized coated with a primed polyurethane encapsulant are also provided.

20 Claims, No Drawings

PRIMER COATING PROVIDING A METALLIZED FABRIC EXHIBITING IMPROVED WASHFASTNESS

FIELD OF THE INVENTION

This invention relates to metallized, particularly aluminized, fabrics which are coated with specific polyurethane finishes and primer coatings comprising novel phosphate-containing primers. Such specific polyurethanes are cross-linked when reacted with the primer coatings and applied in latex form. Upon impregnation within metal-coated fabrics, these particular polyurethanes encapsulate the metal particles and provide vastly improved washfastness properties to the fabrics and thus ensure the retention of substantially all the metal coating within and on the target fabric. The phosphate-containing primer provides remarkably improved adhesion between the metal and the polyurethane for excellent durability and washfastness. The primer compositions as well as the methods of producing a metallized coated with a primed polyurethane encapsulant are also provided.

DISCUSSION OF THE PRIOR ART

Metallized fabrics have recently been utilized in order to provide effective heat insulation for garments, particularly apparel for use outdoors and in cold-weather climates. Other uses for such fabrics have included incorporation within radar-detectable objects, such as in U.S. Pat. No. 4,390,588, to Ebneth et al.; water-repellent automobile covers, as in U.S. Pat. No. 5,271,998, to Duckett et al.; strength-enhanced fibrous materials, as in U.S. Pat. No. 3,660,138, to Gorrell. Washfastness is a very important characteristic which needs to be exhibited by metallized fabrics, particularly those which are intended to be incorporated within garments. Generally, such metal coatings, in particular aluminum, easily washes out of and from fabric substrates upon standard laundering procedures. Past attempts have been made to reduce the loss of metal from such fabrics. These include U.S. Pat. No. 5,744,405, to Okumura et al., which requires a siloxane over coat adhered to the metal-coated fabric through a plasma pre-treatment; and U.K. Patent 800,093, to Kunsch, which discloses the pre-treatment of fabric with cross-linked polyurethanes and the like, prior to depositing metal on the treated fabric surface. The Kunsch pre-treatment basically acts as an adhesive for the metal to remain bonded to the fabric substrate. These methods have proven to be either costly (with the high expense of plasma pre-treatments and particular siloxanes), or ineffective (with the mere utilization of an adhesive to bind the metal to the fabric leaving an appreciable amount of metal susceptible to removal through inadvertent contact and friction with certain surfaces as well as corrosion through atmospheric and aqueous oxidation). There is no teaching or fair suggestion within the prior art which pertains to cost-effective metallized fabrics which provide good heat-retention performance, long-term durability, and improved washfastness (i.e., greater than about 10 washes).

DESCRIPTION OF THE INVENTION

It is thus an object of the invention to provide improved washfastness for metallized fabrics. A further object of the invention is to manufacture a primed polyurethane-coated, aluminized fabric with better washfastness than comparable aluminized fabric or polyurethane-coated aluminized fabric. Another object of the invention is to provide a metallized fabric for incorporation within various different types of garments for the outdoor and cold-weather climate apparel industries which provides effective and appreciable levels of heat insulation throughout the wearable and washable lives of such garments. Yet another object of this invention is to provide a fabric for use in any type of heat insulation covering or fabric and not necessarily within apparel. Still a further object of the invention is to provide a method for producing such a metallized, washfast, heat insulation fabric. A further object of the invention is to provide a novel phosphate-group containing copolymer primer coating to improve the adhesive characteristics of the target polyurethane to the metal particles in the target fabric.

Accordingly, this invention encompasses first a novel copolymer being the reaction product of at least two different monomers, said monomers being (a) a phosphate-containing vinyl monomer and (b) a second, separate vinylic monomer having at least one pendant group having a reactive site thereon, wherein said reactive site is a moiety including a free electronsharing group selected from the group consisting of oxygen, nitrogen, phosphorus, and sulfur. Such a reactive moiety includes, but is not limited to, hydroxyls, amines, amides, epoxides, mercaptans, phosphenes, formaldehyde-type groups, isocyanates, and the like. More particularly, and again only as merely examples, such moieties include epoxides, such as glycidyl ethers, which include oxygens; formaldehyde-type groups, such as alkylolacrylamides which include nitrogens and/or oxygens; hydroxyls, which include oxygen; amines, which include nitrogen; mercaptans, which include sulfur; phosphenes, which include phosphorus; and the like. (Such reactive moieties do not include phosphate groups.) These reactive moieties on the second vinylic monomer of the inventive copolymer may covalently bond with (and thus act as an adhesion promoter for), for example, the polyurethane latex of the inventive method, or the cross-linking agent present within such a latex formulation.

Furthermore, this invention also encompasses a fabric comprising a metal coating wherein said metal coating comprises discrete metal particles which are encapsulated within a cross-linked polyurethane latex, wherein said discrete metal particles are treated with a primer coating composition comprising the reaction product of a copolymer comprising at least two different monomers, wherein said at least two different monomers are (i) a phosphate-containing vinyl monomer and (ii) a second, separate vinylic monomer containing at least one reactive group which is capable of covalently reacting with the cross-linking agent present within the polyurethane latex coating; wherein said metal particles are contacted with said primer coating prior to or during contact with said polyurethane latex, wherein said latex comprises a cross-linking agent. Furthermore, this invention also encompasses a method for improving the washfastness of a metal coating on a metallized fabric through the coating of said metal particles with a cross-linked polyurethane latex comprising the steps of (a) providing a fabric, a portion of which is coated with metal particles; (b) subjecting at least a portion of said metal particles with a primer coating composition comprising the reaction product of a copolymer comprising at least two different monomers, wherein said at least two different monomers are (i) a phosphate-containing vinyl monomer and (ii) a second, separate vinylic monomer containing at least one reactive group which is capable of covalently reacting with the cross-linking agent present within the polyurethane latex coating; and (c) coating at least a portion of said primed metal particles on said fabric with a latex comprising (i) a polyurethane dispersion; (ii) a cross-linking agent; and, optionally, (iii) a catalyst to initiate the crosslinking of said polyurethane dispersion and of said primer coating composition. Nowhere within the prior art has such a specific encapsulated primed metal coating for fabrics been utilized to impede corrosion of the metal particles adhered to the fabric surface thereby substantially eliminating the removal of such metal particles from the fabric substrate due to atmospheric conditions and/or harsh laundering conditions.

The inventive copolymer primer coating, as noted above, must comprise at least two different monomers, one being a phosphate-containing vinylic monomer, the other also requiring the presence of a vinyl group, as well as at least one reactive pendant group wherein the reactive site on such a moiety includes an electron-sharing group. Such a group is, as noted above, selected from nitrogen, oxygen, phosphorus, and sulfur. Thus, any group which contains or makes available such a specific electron-sharing groups is encompassed within the inventive copolymer. Such a primer copolymer performs extremely well within the inventive method of providing effective washfastness to metallized fabrics with a cross-linked polyurethane latex. The phosphate groups of the first monomer bonds strongly with the metal particles within and on the target fabric and the reactive moities within the pendant groups of the second monomer covalently bond with either the polyurethane or cross-linking agent of the latex composition. In order for this inventive primer copolymer to function properly, the second monomer must not include any phosphate groups since such groups react more readily with the metals within the target fabric rather than the reactive sites within the polyurethane latex and/or cross-linking agent within the latex composition. There is no prior teaching of such a specific primer copolymer within the prior art. The closest art, Iris Maege et al., within "Self-assembling adhesion promoters for corrosion resistant metal polymer interfaces," *Progress in Organic Coatings* 34 (1998), pp. 1–12, discloses that certain compounds having terminal phosphate groups and terminal hydroxyls, carboxylates, and the like, can be used to promote adhesion between polymeric coatings and metal surfaces. However, such compounds are not polymeric in nature themselves, do not require a cross-linking agent, do not require a vinylic monomer, and merely provide a single bridging group between the coating and the target metal surface. As noted above, and without intending to be limited to one scientific theory, apparently when the inventive copolymer primer coating is utilized on the target metallized fabric, the phosphate group appears to either react or complex with the metal particles themselves. Such a bond is particularly strong and difficult to break. Since the phosphate group is a component of a monomer, and thus there should exist more than one phosphate-containing group within the copolymer primer, each phosphate group present within the copolymer appears to react or complex with metal particles on the target fabric surface. As the number of phosphate/metal reactive sites grows, the copolymer backbone apparently orients itself parallel to the target fabric surface with the phosphate groups acting as perpendicularly oriented bridging groups between the copolymer and the metal particles. The vinylic components of the two monomers polymerize and/or copolymerize together to form the desired copolymer including the reactive pendant groups discussed above. Again, without intending to be bound to any specific theory, it is believed that these reactive pendant groups are oriented on the copolymer in a direction away from the fabric surface. Such reactive pendant groups then covalently bond with the polyurethane latex, or the cross-linking agent within the latex composition, in order to effectuate the adhesion of the polyurethane over the metallized fabric surface. Such a coating method effectuates encapsulation of the metal particles within and on the target fabric surface. The presence of the inventive copolymer primer coating thus allows for improved adhesion between the polyurethane latex and the metal particles since the phosphate groups and metal particles produce very strong bonds and the reactive pendant groups on the copolymer also bond strongly with the polyurethane latex composition.

Preferably, the inventive copolymer comprises ethylene methacrylate phosphate (available from Albright & Wilson under the tradename Empicryl™ 6835) as the first monomer (with the methacrylate providing the necessary vinylic structure) and N-methylolacrylamide (available from Cytec under the tradename Cylink® NMA) as the preferred second monomer. As noted previously, any vinylic monomer including a non-phosphate reactive pendant group (i.e., hydroxyl, amine, mercaptan, and the like, which can either accept or donate electrons) may be present also or instead, although this specific formaldehyde-type group appears to provide the best overall performance. The presence of vinyl components on both monomers facilitates the formation of strong copolymers. The molecular weight of such an inventive copolymer is very difficult to determine since the number of different chain lengths varies greatly. It is estimated, however, that the average molecular weight exceeds one million. The preferred form of such a copolymer is a viscous liquid having a viscosity of between about 1 and 4,000 centipoise.

Preferably, the addition of said first and second monomers is made at a ratio of from about 0.1:1 to about 1:0.1; preferably, this ratio is from about 0.3:1 to about 1:0.3; more preferably, 0.5:1 to about 1:0.5; and most preferably 0.8:1 to about 1:0.8.

Any fabric can be utilized in this invention since the important requirement is that the polyurethane latex thoroughly coat the metal particulate coating of the fabric in such a way as to substantially prevent contact between the metal and atmospheric oxygen or harsh oxidizing (and thus corrosive) chemicals present within laundry applications. Polyester is most preferred; however, any natural fibers, such as cotton, ramie, and the like; any synthetic fibers, such as polyamides, lycra, and the like; and any blends thereof of any natural and/or synthetic fibers may be utilized within the inventive fabric. Furthermore, woven fabrics are preferred; however, knitted and non-woven forms may also be utilized as well as combinations of any types of these forms. The important limitation of this invention is the presence of the polyurethane latex over the metal coating of the target fabric to provide a barrier to corrosive elements and thus ultimately provide a long-lasting fabric for the retention of heat.

Any metal generally utilized within a coating for fabrics may be utilized within this invention, also. The most common metal for this purpose, aluminum, is most preferred, basically because of its low cost in combination with its superior performance (particularly in provided heat retention for clothing in cold climates). Other metals which may be utilized include copper, silver, nickel, zinc, titanium, vanadium, and the like.

The preferred polyurethane component is a waterborne aliphatic or aromatic polymer which also tends a soft hand to the target fabric. As such, the preferred polyurethane is a dispersion comprising a polyurethane having an elongation of at least 150% and conversely a tensile strength at most 7,000 psi. Particular examples of such dispersions include those within the Witcobond° polyurethane series, from Witco, such as W-232, W-234, W-160, W-213, W-236, W-252, W-290H, W-293, W-320, and W-506; most preferred is W-293. Acrylic polyurethane dispersions may also be utilized provided they exhibit the same required degree of elongation and tensile strength as for the purely polyurethane dispersions.

In addition to the cross-linking groups on the copolymer, any cross-linking agent compatible with polyurethanes may be utilized within the polyurethane dispersion of this invention, particularly those which have low amounts of free formaldehyde. Preferred as crosslinking agents are Cytec™ M3 and Aerotex™ PFK, both available from BFGoodrich. Any catalyst, which is generally necessary to initiate and effectuate cross-linking of a polyurethane dispersion, which is compatible with both a polyurethane and a polyurethane cross-linking agent maybe utilized within this invention. Preferred as a cross-linking catalyst is Cytec™ MX, available from BFGoodrich. The crosslinking agent permits the necessary crosslinking of the polyurethane latex on the target fabric surface and thus the desired encapsulation of the metal particles within and on the target fabric.

The cross-linked polyurethane latex of the invention may be present in any amount and concentration within an aqueous solution for use on and within the target fabric. The table below indicates the difference in performance of the cross-linked polyurethane latex in reference to its concentration and dry solids addition rate on the fabric surface. Preferably, the concentration of the polyurethane is from 5 to 100% by weight of the utilized aqueous solution; more preferably from 10 to about 75% by weight; and most preferably from 25 to about 50% by weight. The coating addition rate (measured as the percent of dry solids addition on the weight of the fabric) of the cross-linked polyurethane dispersion is preferably from 3 to 50% owf; more preferably from about 6 to about 40% owf; and most preferably from about 8 to about 15% owf.

As noted below, three basic procedures may be followed in applying the cross-linked polyurethane dispersion to a metal-coated fabric via a phosphate-containing copolymer primer coating. One alternative is to subject a provided metallized fabric with a composition comprising the inventive copolymer primer coating. The treated fabric is then preferably dried. Subsequently, a polyurethane latex is then formed, separate from the primer and fabric, by combining the polyurethane with a cross-linking agent and optionally a catalyst to effectuate such cross-linking of the polyurethane. The resultant latex is then diluted with water to the desired concentration which will provide the most beneficial washfastness of the metal coating after treatment. The primed metallized fabric is then saturated with the resultant aqueous solution of the polyurethane latex with the excess being removed. Such saturation and removal of the latex (as well as contacting of the primer coating) may be performed in any standard manner, including dipping, padding, immersion, and the like for initial contacting of the dispersion; and wringing, drying, padding, and the like for the removal of the excess. The treated fabric is then dried and cured for a period of time, preferably at a temperature sufficient to effectuate a complete covering of the metal particles previously adhered to the target fabric surface. For example only, a temperature between about 300 and 450° F.; preferably between 310 and 400° F.; more preferably from 325 and 385° F.; and most preferably between 350 and 370° F. are workable. Times of from 5 seconds to 10 minutes are preferred; more preferably from about 10 seconds to about 5 minutes; and most preferably from about 1 minute to 2 minutes.

A second method encompasses the same exact steps as noted above with the exception that there is no drying step for the treated fabric directly after the primer coating is applied to the fabric. Surprisingly, such a drying step is unnecessary and actually results in a reduction in washfastness for the target metallized fabric.

A third, and surprisingly preferred, procedure involves the addition of each component within the same composition prior to contacting with the target metallized fabric substrate. Thus, the primer copolymer coating, the polyurethane latex, the polyurethane cross-linker, and the optional cross-linking catalyst, are all added together to produce a single composition. The target metallized fabric is then dipped, sprayed, etc., with this composition and dried. As this is less expensive step-wise and much easier method to follow than the first alternative, since both procedures effectuate similar degrees of durability (an average of about 20 washes before loss of washfastness of the metal particles from the fabric), this second alternative is the preferred method of production.

Any other standard textile additives, such as dyes, sizing compounds, and softening agents may also be incorporated within or introduced onto the surface of the finished fabric substrate. Particularly desired as optional finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference.

This metal-coated fabric may be incorporated into a garment due to the advantages of its first retaining a substantial amount of metal particles within and on the target fabric after a long duration of wear and standard laundering; and second, retaining a substantial amount of heat due to the presence of a large amount of heat-retaining metal particles within and on the target fabric. Further uses for such a fabric include, without limitation: tents, awnings, blankets, crowd covers, jackets, scarves, and the like.

DESCRIPTION OF THE PREFERRED EMBODIMENT

The following examples are indicative of the preferred embodiment of this invention:

Batch Polymerization of the Inventive Copolymer

EXAMPLE 1

The following materials were charged to a four-neck flask reactor (which included a temperature probe, nitrogen inlet, condenser/nitrogen outlet, and a mechanical stirrer): 4.5 g of Empicryl™ 6835, 0.5 g of Cylink® NMA (48% solids), and 95 g of distilled water. After being purged with nitrogen for 30 minutes, the reactor was then sealed and placed within a temperature-controlled hot oil bath at 75° C. At the same time, two separate catalyst solutions were prepared in separate vials, one comprising 0.068 g of sodium bisulfite in 10 g of distilled water and the other comprising 0.068 g of ammonium persulfate in 10 g of distilled water. To initiate the polymerization of the copolymer with the cross-linking agent, 1.0 mL each of these two solutions were added to the reactor flask. After reaction for 1.5 hours, another 0.2 mL each of these two solutions were added. The reaction proceeded for another hour and the product was then cooled to room temperature. The resultant composition was clear with a high viscosity.

Production of the Inventive Coated Fabric

EXAMPLE 2

A 100% nylon, 4×1 sateen woven fabric (115/34 warp-drawn warp yarn and 150/50 textured fill yarn, having a fabric weight of 3.5 ounces per square yard) was evaporation-coated with 0.24% (wt.) of aluminum produced by Diversified Fabrics Inc. The resultant fabric was then dipped into a 0.1% solution of the product from EXAMPLE 1, above and squeezed between rollers to remove any excess. The treated fabric was then dried at 250° F. for 3 minutes. The resultant primed fabric was then dipped into a mixture of 72.4 g Witcobond® W-293 (polyurethane dispersion available from Witco), 1 gram of Cytec™ M3 (cross-linking agent available from BFGoodrich), and 0.6 gram of Cytec™ MX (catalyst available from BFGoodrich), 2.2 g of Freerez® PFK (BFGoodrich), 0.4 g Synfac® TDA-92 (Milliken), 0.8 g Igepal® DAP-9 (Rhône-Poulenc), and 163.2 g distilled water, squeezed between rollers to remove excess liquid, and dried at 350° F. for 4 minutes. The coated fabric was then washed according to AATCC Test Method 130-1995, "Soil Release: Oily Stain Release Method" and measured for aluminum retention after different numbers of washes. The washfastness of the latex encapsulate remaining aluminum was measured visually and withstood 18 rotary washing and tumble drying cycles.

EXAMPLE 3

The same method was followed as in EXAMPLE 2, above, except there was no drying step performed after the application of the primer copolymer coating step. The washfastness of the latex encapsulate remaining aluminum was measured visually and withstood at least 20 rotary washing and tumble drying cycles.

EXAMPLE 4

A 100% nylon, 4×1 sateen woven fabric (115/34 warp-drawn warp yarn and 150/50 textured fill yarn, having a fabric weight of 3.5 ounces per square yard) was evaporation-coated with 0.24% (wt.) of aluminum produced by Diversified Fabrics Inc. The resultant fabric was then dipped into a mixture of 0.24 g of the product from EXAMPLE 1, 72.4 g Witcobond® W-293, 1 gram of Cytec™ M3, and 0.6 gram of Cytec™ MX, 2.2 g of Freerez® PFK, 0.4 g Synfac® TDA-92, 0.8 g Igepal® DAP-9, and 163.2 g distilled water, squeezed between rollers to remove excess liquid, and dried at 350° F. for 4 minutes. The coated fabric was then washed according to AATCC Test Method 130-1995, "Soil Release: Oily Stain Release Method" and measured for aluminum retention after different numbers of washes. The washfastness of the latex encapsulate remaining aluminum was measured visually and withstood 20 rotary washing and tumble drying cycles.

EXAMPLE 5 (Comparative)

A 100% nylon, 4×1 sateen woven fabric (115/34 warp-drawn warp yarn and 150/50 textured fill yam, having a fabric weight of 3.5 ounces per square yard) was evaporation-coated with 0.24% (wt.) of aluminum produced by Diversified Fabrics Inc. The resultant fabric was then dipped into a mixture of 72.4 g Witcobond® W-293 (polyurethane dispersion available from Witco), 1 gram of Cytec™ M3 (cross-linking agent available from BFGoodrich), and 0.6 gram of Cytec™ MX (catalyst available from BFGoodrich), 2.2 g of Freerez® PFK (BFGoodrich), 0.4 g Synfac® TDA-92 (Milliken), 0.8 g Igepal® DAP-9 (Rhône-Poulenc), and 163.2 g -distilled water, squeezed between rollers to remove excess liquid, and dried at 350° F. for 4 minutes. The coated fabric was then washed according to AATCC Test Method 130-1995, "Soil Release: Oily Stain Release Method" and measured for aluminum retention after different numbers of washes. The washfastness of the latex encapsulate remaining aluminum was measured visually and withstood 2 rotary washing and tumble drying cycles.

As is clearly evident, the washfastness of the aluminum improved dramatically upon the utilization of the inventive primer copolymer coating prior to or during the cross-linked polyurethane encapsulation step.

There are, of course, many alternative embodiments and modifications of the present invention which are intended to be included within the spirit and scope of the following claims.

What we claim is:

1. A fabric comprising a metal coating wherein said metal coating comprises discrete metal particles which are encapsulated within a cross-linked polyurethane latex, wherein said discrete metal particles are treated with a primer coating composition comprising the reaction product of a copolymer comprising at least two different monomers, wherein said at least two different monomers are (i) a phosphate-containing vinyl monomer and (ii) a second, separate vinylic monomer containing at least one non-phosphate reactive group which is capable of covalently reacting with the cross-linking agent present within the polyurethane latex coating;

wherein said primer coating metal particles are contacted with said primer coating prior to or during contact with said polyurethane latex; and wherein said latex comprises a cross-linking agent and optionally a catalyst to initiate the crosslinking of said polyurethane dispersion and of said primer coating composition.

2. The fabric of claim 1 wherein said polyurethane latex comprises a polyurethane dispersion having an elongation of at least 150%.

3. A garment comprising the fabric of claim 2.

4. The fabric of claim 1 wherein said metal particles comprise aluminum particles.

5. The fabric of claim 4 wherein said phosphate-containing primer coating comprises at least one vinyl-containing moiety.

6. The fabric of claim 5 wherein said at least one vinyl-containing moiety is an acrylate group.

7. A garment comprising the fabric of claim 6.

8. A garment comprising the fabric of claim 5.

9. A garment comprising the fabric of claim 4.

10. A garment comprising the fabric of claim 1.

11. A method for improving the washfastness of a metal coating on a metallized fabric through the coating of said metal particles with a cross-linked polyurethane latex comprising the steps of (a) providing a fabric, a portion of which is coated with metal particles;

(b) subjecting at least a portion of said metal particles with a primer coating composition comprising the reaction product of a copolymer comprising at least two different monomers, wherein said at least two different monomers are (i) a phosphate-containing vinyl monomer and (ii) a second, separate vinylic monomer containing at least one non-phosphate reactive group which is capable of covalently reacting with the cross-linking agent present within the polyurethane latex coating; and (c) coating at least a portion of said primed metal particles on said fabric with a latex comprising (i) a polyurethane dispersion;

(ii) a cross-linking agent; and, optionally, (iii) a catalyst to initiate the crosslinking of said polyurethane dispersion and of said primer coating composition.

12. A garment comprising the fabric produced by the method of claim 11.

13. The method of claim 11 wherein said polyurethane latex comprises a polyurethane dispersion having an elongation of at least 150%.

14. A garment comprising the fabric produced by the method of claim 13.

15. The fabric of claim 13 wherein said metal particles comprise aluminum particles.

16. A garment comprising the fabric produced by the method of claim 15.

17. The method of claim 15 wherein said phosphate-containing primer coating comprises at least one vinyl-containing moiety.

18. A garment comprising the fabric produced by the method of claim 17.

19. The method of claim 15 wherein said at least one vinyl-containing moiety is an acrylate group.

20. A garment comprising the fabric produced by the method of claim 19.

* * * * *